US010066563B2

(12) United States Patent
Jalel

(10) Patent No.: US 10,066,563 B2
(45) Date of Patent: Sep. 4, 2018

(54) CLOSED-LOOP ADAPTIVE CONTROLS FROM CYCLE-TO-CYCLE FOR INJECTION RATE SHAPING

(71) Applicant: CUMMINS INC., Columbus, IN (US)

(72) Inventor: Syed Shah Jalel, Indianapolis, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 15/569,736

(22) PCT Filed: Apr. 28, 2015

(86) PCT No.: PCT/US2015/027911
§ 371 (c)(1),
(2) Date: Oct. 26, 2017

(87) PCT Pub. No.: WO2016/175757
PCT Pub. Date: Nov. 3, 2016

(65) Prior Publication Data

US 2018/0142638 A1 May 24, 2018

(51) Int. Cl.

| | |
|---|---|
| ***F02D 41/00*** | (2006.01) |
| ***F02D 41/14*** | (2006.01) |
| ***F02D 41/20*** | (2006.01) |
| *F02D 35/02* | (2006.01) |
| *F02D 41/28* | (2006.01) |

(52) U.S. Cl.
CPC ..... *F02D 41/1402* (2013.01); *F02D 41/2096* (2013.01); *F02D 35/023* (2013.01); *F02D 2041/141* (2013.01); *F02D 2041/1434* (2013.01); *F02D 2041/2051* (2013.01); *F02D 2041/2058* (2013.01);
(Continued)

(58) Field of Classification Search
CPC ..... F02D 41/1402; F02D 41/2096; F02D 2041/2051; F02D 2200/0602; F02D 2041/286; F02D 2041/1434; F02D 2041/141; F02D 2041/2058
See application file for complete search history.

(56) References Cited

U.S. PATENT DOCUMENTS 4,532,592 A 7/1985 Citron et al.
5,590,638 A 1/1997 Nishimura et al.
(Continued)

FOREIGN PATENT DOCUMENTS

WO 2015/039095 3/2015

OTHER PUBLICATIONS

International Search Report and Written Opinion dated Jul. 28, 2015.

*Primary Examiner* — Thomas Moulis
(74) *Attorney, Agent, or Firm* — Faegre Baker Daniels LLP

(57) ABSTRACT

The present disclosure provides a system for adjusting a fuel injector drive signal during a fuel injection event wherein the system comprises an engine having a fuel injector, a fuel control module configured to generate control signals corresponding to a desired fueling profile of a fuel injection event, and a fueling profile interface module that outputs drive profile signals to the fuel injector in response to the control signals to cause the fuel injector to deliver an actual fueling profile, wherein the fueling profile interface module changes the drive profile signals during the fuel injection event in response to a parameter signal indicating a characteristic of the actual fueling profile.

17 Claims, 7 Drawing Sheets

(52) U.S. Cl.
CPC .. *F02D 2041/281* (2013.01); *F02D 2041/286* (2013.01); *F02D 2200/0602* (2013.01)

(56) References Cited

U.S. PATENT DOCUMENTS

| | | | | |
|---|---|---|---|---|
| 5,619,969 | A | 4/1997 | Liu et al. | |
| 5,692,485 | A | 12/1997 | Maki et al. | |
| 5,755,212 | A * | 5/1998 | Ajima | F02D 41/1405 123/674 |
| 5,983,863 | A | 11/1999 | Cavanaugh et al. | |
| 6,199,533 | B1 | 3/2001 | Morris et al. | |
| 7,287,515 | B2 * | 10/2007 | Okamura | F02D 41/40 123/456 |
| 7,334,741 | B2 | 2/2008 | Benson et al. | |
| 7,451,037 | B2 | 11/2008 | Ikeda | |
| 7,596,992 | B2 | 10/2009 | Asano et al. | |
| 7,599,784 | B2 | 10/2009 | Ishizuka et al. | |
| 7,650,226 | B2 | 1/2010 | Ishizuka et al. | |
| 7,891,337 | B2 | 2/2011 | Takeuchi et al. | |
| 7,895,990 | B2 | 3/2011 | Ishizuka et al. | |
| 7,912,622 | B2 | 3/2011 | Yamaguchi | |
| 8,219,302 | B2 | 7/2012 | Yamashita et al. | |
| 9,562,505 | B2 | 2/2017 | Hokkanen et al. | |
| 9,677,496 | B2 * | 6/2017 | Carey | F02D 41/402 |
| 9,803,578 | B2 * | 10/2017 | Russe | F02D 41/2096 |
| 2002/0023622 | A1 * | 2/2002 | Rueger | F02D 41/2096 123/490 |
| 2003/0041843 | A1 * | 3/2003 | Shinogle | F02D 41/2467 123/486 |
| 2009/0063018 | A1 * | 3/2009 | Takeuchi | F02D 41/1497 701/104 |
| 2009/0090333 | A1 * | 4/2009 | Spadafora | F02D 41/2096 123/494 |
| 2009/0093947 | A1 * | 4/2009 | Schnorbus | F02D 35/02 701/103 |
| 2009/0177366 | A1 * | 7/2009 | Achleitner | F02D 41/0087 701/103 |
| 2009/0326788 | A1 * | 12/2009 | Yuasa | F02D 41/3809 701/104 |
| 2012/0330576 | A1 * | 12/2012 | Mikami | F02M 57/005 702/50 |
| 2013/0019842 | A1 * | 1/2013 | Shaver | F02C 9/26 123/478 |
| 2013/0066538 | A1 * | 3/2013 | Brandt | F02D 41/2096 701/105 |
| 2013/0133748 | A1 * | 5/2013 | Lehner | F02D 41/247 137/1 |
| 2013/0333455 | A1 * | 12/2013 | Hoffmann | F02D 41/2096 73/114.15 |
| 2014/0283792 | A1 * | 9/2014 | Benson | F02D 41/2467 123/478 |
| 2016/0017837 | A1 * | 1/2016 | Carey | F02D 41/402 123/480 |
| 2016/0222905 | A1 * | 8/2016 | Syed | F02D 41/20 |

* cited by examiner

CLOSED-LOOP ADAPTIVE CONTROLS FROM CYCLE-TO-CYCLE FOR INJECTION RATE SHAPING

RELATED APPLICATIONS

The present application is a national phase filing under 35 U.S.C. § 371 of International Application No. PCT/US2015/027911, titled "CLOSED-LOOP ADAPTIVE CONTROLS FROM CYCLE-TO-CYCLE FOR INJECTION RATE SHAPING," filed on Apr. 28, 2015, the entire disclosure of which being expressly incorporated herein by reference.

FIELD OF THE DISCLOSURE

This disclosure generally relates to fuel injection rate shaping and more particularly to systems and methods for providing closed-loop adaptive controls from cycle-to-cycle to enhance within-cycle closed-loop techniques and improve the correlation between an actual injected rate shape and a target rate shape.

BACKGROUND OF THE DISCLOSURE

To provide fuel to a combustion chamber of an internal combustion engine, which may be described as an injection event, a fuel injector receives a drive profile signal from a controller of the engine to produce a "rate shape" of the fuel injection. Depending on the engine operating conditions, the rate shapes to be delivered to the combustion chamber by the fuel injector during an injection event can be varied (e.g., the fuel injector may be controlled to provide a trapezoid shape, a square shape, or a boot shape injection profile to name a few).

By varying the Piezo voltage profile (i.e., the control input or drive profile signal characteristics), the needle position of the fuel injector can be varied to inject a desired rate shape of the fuel injection to the combustion chamber. Regulating needle position to achieve a specified rate shape within a tight tolerance presents challenges in open-loop operation. Imprecise rate shapes result generally in undesirable engine performance (i.e., reduced fuel efficiency and increased emissions output). Therefore, a within the injection cycle closed-loop technique ("within-cycle") was developed and disclosed in PCT Patent Application No. PCT/US2014/55856, filed Sep. 16, 2014, entitled "SYSTEM FOR ADJUSTING A FUEL INJECTOR ACTUATOR DRIVE SIGNAL DURING A FUEL INJECTION EVENT" (hereinafter referred to as "the Within-Cycle Application"), the entire disclosure of which being expressly incorporated herein by reference. While the teachings of the Within-Cycle Application improve the accuracy of fuel injection events to a large extent (i.e., in terms of matching the actual rate shape to the desired rate shape), the closed-loop system performance of the fuel injectors is still adversely affected by the time delay between the output rate shape and the measured sense signal(s) used to produce the output. In general, because of this time delay, the within-cycle techniques alone still permit some error between the desired rate shape and the actual rate shape of the fuel injection profile.

SUMMARY OF THE DISCLOSURE

The present disclosure addresses the rate shape profile error associated with within-cycle techniques especially in steady-state operation, by combining the within-cycle closed-loop controls with cycle-to-cycle controls which learn (i.e., adapt) the control inputs to the fuel injector based on previous cycles of operation and correct the rate profile input to provide precision rate shaping. Thus, according to the principles of the present disclosure, the overall control signal includes a within-cycle closed loop input and an adaption input which learns from the previous cycles of operation. The control signal may use one or many types of sensor signals including state estimations. Such inputs may include one or more of the followings: body pressure or HPC pressure, Piezo stack voltage/current, piezo feedback sensor force, piezo charge, piezo energy, cylinder pressure, etc.), either as provided by a sensed signal or an estimated signal.

In one embodiment of the present disclosure, a system is provided, comprising an engine having a fuel injector, a controller configured to generate control signals corresponding to a desired fueling profile of a fuel injection event for the fuel injector, an interface module that outputs drive profile signals to the fuel injector in response to the control signals to cause the fuel injector to deliver an actual fueling profile, wherein the interface module adjusts the drive profile signals to reduce an error between the desired fueling profile and the actual fueling profile in response to a parameter signal indicating a characteristic of the actual fueling profile determined during a cycle of the fuel injection event, and an adaptation module that adjusts the drive profile signals to reduce the error between the desired fueling profile and the actual fueling profile in response to a performance index of the actual fueling profile determined during at least one previous cycle of the fuel injection event. In one aspect of this embodiment, the performance index includes an absolute value of a sum of errors between the desired fueling profile and the actual fueling profile for a selected time window of interest. In another aspect, the performance index includes a sum of a square of errors between the desired fueling profile and the actual fueling profile for a selected time window of interest. In still another aspect, the adaptation module generates an adaptation output that is combined with the drive profile signals, the adaptation output for a current cycle being the same as the adaptation output for a previous cycle when the adaptation output for the current cycle does not exceed a threshold. In a variant of this aspect, the adaptation module modifies the adaptation output for the current cycle by an increment when the adaptation output for the current cycle exceeds the threshold. In another aspect of this embodiment, the parameter signal includes at least one of a cylinder pressure, a fuel accumulator pressure, and an engine crank angle.

In another embodiment of the present disclosure, a control system is provided, comprising a controller having an output that provides a control signal indicative of a desired rate shape of a fuel injection event, an interface module having an input that receives the control signal, a feedback output that provides a feedback signal indicative of an actual rate shape of the fuel event and a drive output that provides a drive signal for controlling operation of a fuel injector, wherein the drive signal includes an open-loop component generated from the control signal, a closed-loop within-cycle component generated from an error between the control signal and the feedback signal during the fuel injection event, and a closed-loop adaptation component generated from an error between the control signal and the feedback signal during a prior fuel injection event. In one aspect of this embodiment, the adaptation component is generated in response to a performance index of the actual rate shape during the prior fuel injection event. In a variant of this aspect, the performance index includes an absolute value of a sum of errors between the desired rate shape and the actual rate shape for a selected time window of interest. In another variant, the performance index includes a sum of a square of errors between the desired rate shape and the actual rate shape for a selected time window of interest. In another aspect of this embodiment, an adaptation module generates the adaptation component such that the adaptation component for a current cycle of operation of the adaptation module is unchanged for a next cycle of operation when a performance index of the adaptation component for the current cycle does not satisfy a criteria. In a variant of this aspect, the adaptation module modifies the adaptation component for a current cycle by an increment to generate the adaptation component for the next cycle when the performance index of the adaptation component for the current cycle satisfies the criteria.

According to another embodiment of the present disclosure, a method is provided comprising providing a drive profile signal to a fuel injector to cause a fuel injection event having a desired rate shape, the fuel injection event including a plurality of cycles, determining, for each of the plurality of cycles, an error signal representing a difference between the drive profile signal and a feedback signal indicating an actual rate shape of the fuel injection event, providing, for a current cycle, a within-cycle adjustment to the drive profile signal in response to the error signal, and providing, for the current cycle, an adaptation adjustment to the drive profile signal in response to the error signal and a performance index of the error signal during a previous injection event. In one aspect of this embodiment, the adaptation adjustment is zero when the performance index of the actual rate shape during the previous injection event does not satisfy a criteria and the adaptation adjustment is non-zero when the performance index satisfies the criteria. In another aspect, providing an adaptation adjustment includes determining the performance index by computing an absolute value of a sum of errors between the desired rate shape and the actual rate shape for a selected time window. In yet another aspect, providing an adaptation adjustment includes determining the performance index by computing a sum of a square of errors between the desired rate shape and the actual rate shape for a selected time window. Another aspect further includes combining a feedforward adjustment to the drive profile signal in response to operating conditions of the fuel injector.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

DETAILED DESCRIPTION OF EMBODIMENTS

In certain embodiments, engine 10 described below includes a control system structured to perform certain operations to control a fuel subsystem. In certain embodiments, the control system forms a portion of a processing subsystem including one or more computing devices having a memory or multiple memories, a processor or multiple processors, and various communication hardware components. The processing subsystem may be a single device or a distributed device, and the functions of a controller of the subsystem (described below) may be performed by hardware and/or as computer instructions on a non-transient computer readable storage medium.

One of skill in the art, having the benefit of the disclosures herein, will recognize that in certain embodiments of the present disclosure a controller may be structured to perform operations that improve various technologies and provide improvements in various technological fields. Without limitation, non-limiting examples of such technologies may include improvements in combustion performance of internal combustion engines, improvements in emissions performance, aftertreatment system regeneration, engine torque generation and torque control, engine fuel economy performance, durability of exhaust system components for internal combustion engines, and engine noise and vibration control.

Certain operations described herein include operations to interpret and/or to determine one or more parameters. Interpreting or determining, as utilized herein, includes receiving values by any method known in the art, including at least receiving values from a datalink or network communication, receiving an electronic signal (e.g., a voltage, frequency, current, or PWM signal) indicative of the value, receiving a computer generated parameter indicative of the value, reading the value from a memory location on a non-transient computer readable storage medium, receiving the value as a run-time parameter by any means known in the art, receiving a value by which the interpreted parameter can be calculated, and/or by referencing a default value that is interpreted to be the parameter value.

Figure 1:
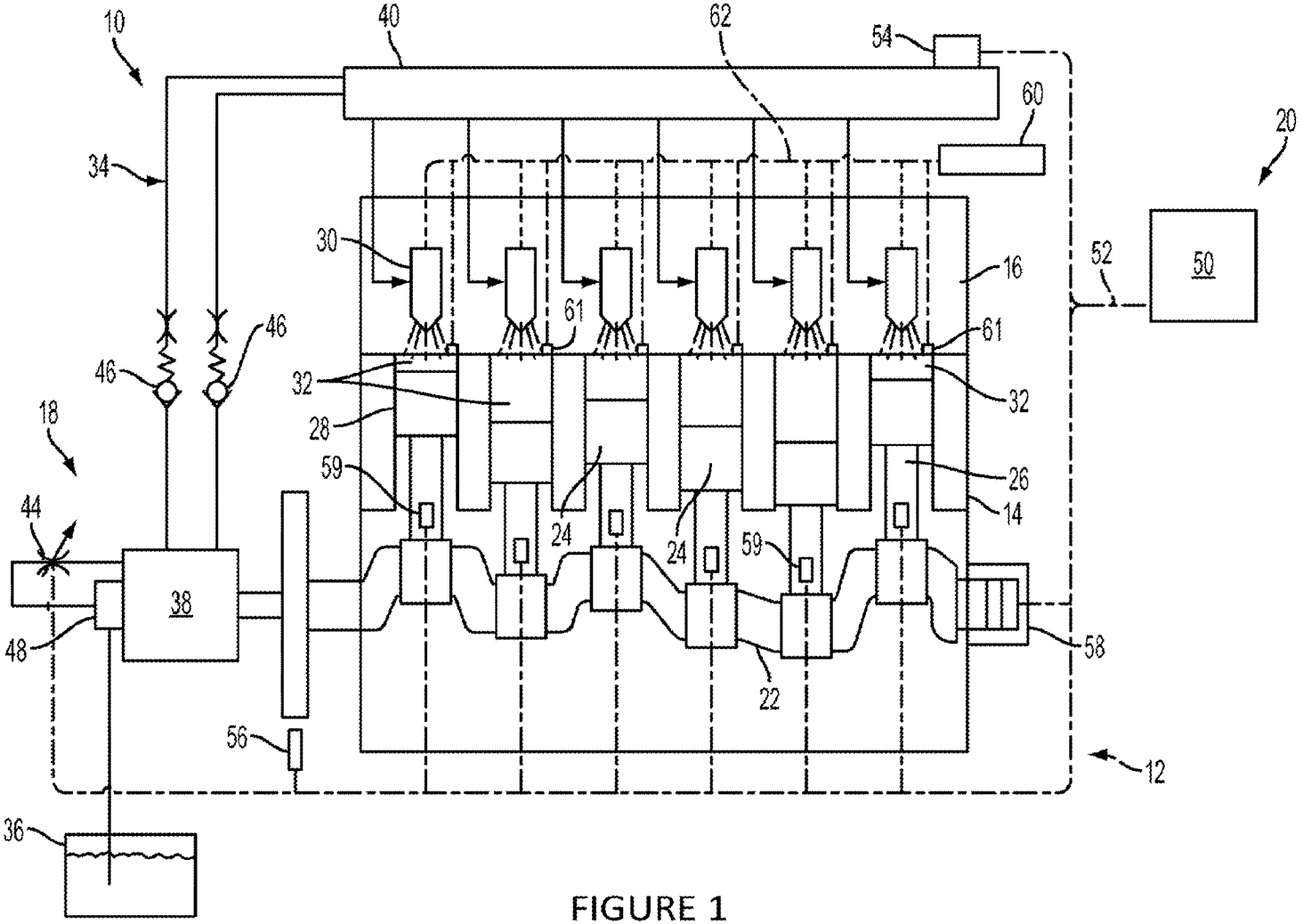
FIG. 1 is a schematic of an internal combustion engine and associated fueling system.

Referring now to FIG. 1, a portion of an internal combustion engine in accordance with an exemplary embodiment of the present disclosure is shown as a simplified schematic and generally indicated by reference numeral 10. Engine 10 generally includes an engine body 12, which includes an engine block 14 and a cylinder head 16 attached to engine block 14, a fuel system 18, and a control system 20. Control system 20 receives signals from sensors located on engine 10 and transmits control signals to devices located on engine 10 to control the function of those devices, such as one or more fuel injectors as described below.

While engine 10 works well for its intended purpose, one challenge is optimizing the efficiency of combustion in engine 10 (in terms of fuel efficiency and emissions controls, for example). Various techniques have been proposed to improve the efficiency of combustion, such as rate shaping of the fuel injections by the fuel injectors (i.e., controlling the fuel injection events of the fuel injectors to deliver quantities of fuel at different rates during the events to provide more efficient combustion and reduced emissions). Examples of rate shaping systems and methods are described in U.S. Pat. Nos. 5,619,969, 5,983,863, 6,199,533, and 7,334,741, the entire contents of which are hereby expressly incorporated herein by reference in their entirety. Other techniques for rate shaping include providing a constant fuel flow rate while varying fuel flow pressure. Further details regarding the use and implementation of fuel injectors having a capability of providing a constant fuel flow rate with a variable pressure are set forth in detail in co-pending U.S. patent application Ser. No. 13/915,305, filed on Jun. 13, 2013, the entire content of which is hereby expressly incorporated herein by reference.

The present disclosure provides an improved system of adjusting a fuel injector actuator drive profile signal during a fuel injection event that includes closed-loop within-cycle correction of the drive profile signal and cycle-to-cycle closed-loop adaptive control of the drive profile signal that adapts to and corrects for the time delay between the output rate shape and the measured sense signal(s) used to produce the output. By accounting for this delay and adjusting the fuel injector actuator drive profile signal accordingly, including the shape of the drive profile signal, the amplitude of the drive profile signal, and the length of the drive profile signal, fueling for each injection event may be improved. Examples of the types of fuel injector actuators that may be used are piezoelectric or magnetostrictive actuators. However, any fuel injector actuator that responds in proportion to the amplitude of the voltage and/or current of the drive profile signal may be used.

Engine body 12 includes a crank shaft 22, a plurality of pistons 24, and a plurality of connecting rods 26. Pistons 24 are positioned for reciprocal movement in a plurality of corresponding engine cylinders 28, with one piston positioned in each engine cylinder 28. One connecting rod 26 connects each piston 24 to crank shaft 22. As will be understood by those skilled in the art, the movement of pistons 24 under the action of a combustion process in engine 10 causes connecting rods 26 to move crankshaft 22.

A plurality of fuel injectors 30 are positioned within cylinder head 16. Each fuel injector 30 is fluidly connected to a combustion chamber 32, each of which is formed by one piston 24, cylinder head 16, and the portion of engine cylinder 28 that extends between a respective piston 24 and cylinder head 16. Fuel system 18 provides fuel to injectors 30, which is then injected into combustion chambers 32 by the action of fuel injectors 30, forming one or more fuel injection events. Such fuel injection events may be defined as the interval of time that begins with the movement of a nozzle or needle valve element (not shown) of the fuel injector 30, permitting fuel to flow from fuel injector 30 into an associated combustion chamber 32, until the nozzle or needle valve element blocks the flow of fuel from fuel injector 30 into combustion chamber 32.

Fuel system 18 includes a fuel circuit 34, a fuel tank 36, which contains fuel, a high-pressure fuel pump 38 positioned along fuel circuit 34 downstream from fuel tank 36, and a fuel accumulator or rail 40 positioned along fuel circuit 34 downstream from high-pressure fuel pump 38. While fuel accumulator or rail 40 is shown as a single unit or element, accumulator 40 may be distributed over a plurality of elements that transmit or receive high-pressure fuel, such as fuel injector(s) 30, high-pressure fuel pump 38, and any lines, passages, tubes, hoses and the like that connect high-pressure fuel to the plurality of elements. Fuel system 18 may further include an inlet metering valve 44 positioned along fuel circuit 34 upstream of high-pressure fuel pump 38 and one or more outlet check valves 46 positioned along fuel circuit 34 downstream of high-pressure fuel pump 38 to permit one-way fuel flow from high-pressure fuel pump 38 to fuel accumulator 40. Though not shown, additional elements may be positioned along fuel circuit 34. For example, inlet check valves may be positioned downstream of inlet metering valve 44 and upstream of high-pressure fuel pump 38, or inlet check valves may be incorporated in high-pressure fuel pump 38. Inlet metering valve 44 has the ability to vary or shut off fuel flow to high-pressure fuel pump 38, which thus shuts off fuel flow to fuel accumulator 40. Fuel circuit 34 connects fuel accumulator 40 to fuel injectors 30, which receive fuel from fuel accumulator 40 and then provide controlled amounts of fuel to combustion chambers 32. Fuel system 18 may also include a low-pressure fuel pump 48 positioned along fuel circuit 34 between fuel tank 36 and high-pressure fuel pump 38. Low-pressure fuel pump 48 increases the fuel pressure to a first pressure level prior to fuel flowing into high-pressure fuel pump 38.

Control system 20 may include a control module or controller 50, a wire harness 52, an interface module 60, and an interface module wire harness 62. Control system 20 may also include an accumulator pressure sensor 54, a cylinder pressure sensor that measures, either directly or indirectly, cylinder pressure, and a crank angle sensor (described below). While sensor 54 is described as being a pressure sensor, sensor 54 may represent other devices that may be calibrated to provide a pressure signal that represents fuel pressure, such as a force transducer, a strain gauge, or other device. The cylinder pressure sensor may be a sensor such as a strain gauge sensor 59 positioned in a location to measure the force generated in combustion chamber 32. For example, strain gauge sensor 59 may be positioned along connecting rod 26, as shown in the exemplary embodiment of FIG. 1, and thus strain gauge sensor 59 indirectly measures the pressure in combustion chamber 32. A cylinder pressure sensor 61 may be positioned to directly measure pressure in combustion chamber 32. The crank angle sensor may be a toothed wheel sensor 56, a rotary Hall sensor 58, or other type of device capable of measuring the rotational angle of crankshaft 22. Control system 20 uses signals received from accumulator pressure sensor 54 and the crank angle sensor to determine the combustion chamber receiving fuel.

Controller 50 may be an electronic control unit or electronic control module ("ECM") that may monitor conditions of engine 10 or an associated vehicle powered by engine 10. Controller 50 may be a single processor, a distributed processor, an electronic equivalent of a processor, or any combination of the aforementioned elements, as well as software, electronic storage, fixed lookup tables and the like. Controller 50 may include digital and/or analog circuitry. Controller 50 may connect to certain components of engine 10 by wire harness 52, though such connection may be by other means, including a wireless system. For example, controller 50 may connect to and provide control signals to inlet metering valve 44 and to interface module 60. Interface module 60 connects to fuel injectors 30 by way of interface module wire harness 62.

When engine 10 is operating, combustion in combustion chambers 32 causes the movement of pistons 24. The movement of pistons 24 causes movement of connecting rods 26, which are drivingly connected to crankshaft 22, and movement of connecting rods 26 causes rotary movement of crankshaft 22. The angle of rotation of crankshaft 22 is monitored by controller 50 to aid in timing of combustion events in engine 10 and for other purposes. The angle of rotation of crankshaft 22 may be measured in a plurality of locations, including a main crank pulley (not shown), an engine flywheel (not shown), an engine camshaft (not shown), or on the camshaft itself. Measurement of crankshaft 22 rotation angle may be made with toothed wheel sensor 56, rotary Hall sensor 58, and by other techniques. A signal representing the angle of rotation of crankshaft 22, also called the crank angle, is transmitted from toothed wheel sensor 56, rotary hall sensor 58, or other device to controller 50.

Fuel pressure sensor 54 is coupled to fuel accumulator 40 and is capable of detecting or measuring the fuel pressure in fuel accumulator 40. Fuel pressure sensor 54 transmits or sends signals indicative of the fuel pressure in fuel accumulator 40 to controller 50. Fuel accumulator 40 is connected to each fuel injector 30. Control system 20 provides control signals to fuel injectors 30 that determine operating parameters for each fuel injector 30, such as the length of time fuel injectors 30 operate and the rate of fuel injected during a fuel injection event, which determines the amount of fuel delivered by each fuel injector 30.

Figure 2:
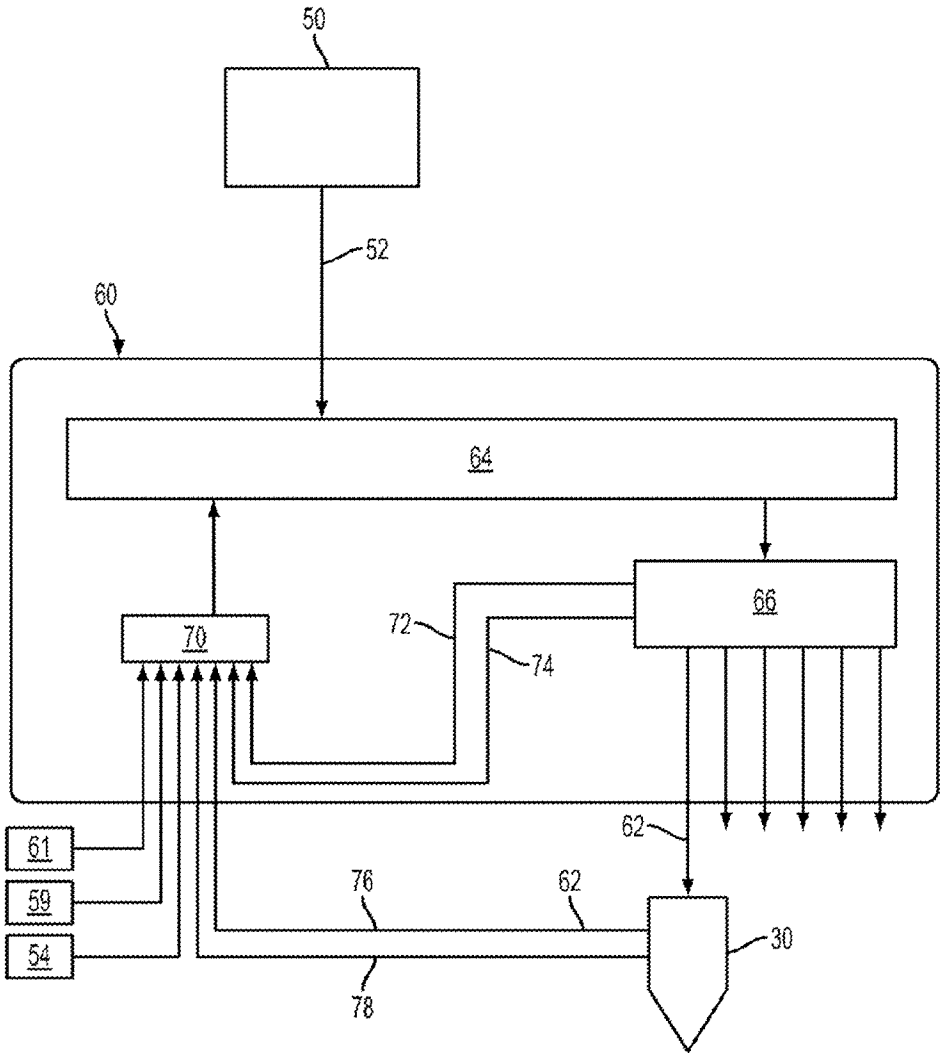
FIG. 2 is a schematic of a within-cycle control system.

Referring now to FIG. 2, interface module 60 may include an Application Specific Integrated Circuit ("ASIC") that may be implemented as a Field Programmable Gate Array ("FPGA"), or ASIC/FPGA 64. ASIC/FPGA 64 is a high-speed device that accepts signals from controller 50 and from other locations, described further herein below, and generates a fuel injector drive profile signal that includes various drive characteristics, including a shape of the drive profile signal, an amplitude of the drive profile signal, and a duration or pulse width of the drive profile signal. Interface module 60 further includes a fuel injector driver 66, and an Analog-to-Digital Converter ("ADC") 70.

ASIC/FPGA 64 transmits the fuel injector drive profile signal to fuel injector driver 66, which amplifies the fuel injector drive profile signal and then transmits the drive profile signal to each of the plurality of fuel injectors 30 when commanded by controller 50. Fuel injector driver 66 transmits one or more feedback signals to ADC 70, which may include a signal indicative of the drive voltage and the drive current, which may be described as a piezoelectric, piezo, or magnetostrictive drive voltage signal 72 and a piezoelectric, piezo, or magnetostrictive drive current signal 74.

Fuel injector 30 may include a sensor connected to the interior of fuel injector 30, or to fuel circuit 34 between fuel rail or accumulator 40 and fuel injector 30, which provides an analog line pressure signal 76 as a feedback signal to ADC 70. Fuel injector 30 may also include a sensor that provides an analog actuator feedback signal 78 proportional to the actual movement of a fuel injector actuator, a needle or nozzle valve element (not shown) position, a fuel injection rate shape, or other component or feature that is configured to operate in response to the drive profile signal. Such a sensor may be, for example, a piezoelectric feedback force sensor. A signal indicative of pressure in combustion chamber 32, which may be described as a cylinder pressure signal, may be transmitted to ADC 70 from a sensor such as strain gauge sensor 59 and/or cylinder pressure sensor 61. The analog signal transmitted by accumulator pressure sensor 54 may also be provided to ADC 70.

ADC 70 receives the plurality of analog feedback signals and changes the plurality of analog feedback signals into a serial digital signal that is transmitted to ASIC/FPGA 64. Because ADC 70 may be limited in the number of inputs, or for reasons of speed, multiple analog to digital converters may be provided to receive the plurality of feedback signals associated with each fuel injector 30. Because one aspect of the system of the present disclosure uses feedback signals to control the fuel injector drive profile signal, the disclosed system is considered a closed-loop system.

After ASIC/FPGA 64 receives the feedback signal(s), ASIC/FPGA 64 analyzes the actual fuel injection rate and calculates the amount of fuel being delivered by fuel injector 30 during the injection event. If the fuel injection rate deviates from the fuel injection rate expected based on the fuel injector drive profile signal established by controller 50, or if the amount of fuel being delivered by fuel injector 30 is different from the amount of fuel requested by controller 50, ASIC/FPGA 64 modifies the fuel injector drive profile signal to correct or adjust the fuel injector drive profile signal and/or adjust the amount of fuel delivered while the injection event is in progress in the manner described in the Within-Cycle Application. ASIC/FPGA 64 may also modify the fuel injector drive profile signal during an injection if requested by controller 50. Because ASIC/FPGA 64 is a dedicated circuit, it may function to receive various signals, to analyze them, and to modify the fuel injector drive profile signal nearly in real time, with a response time that is approximately 10 microseconds or less in comparison to a fuel injection event that extends over an interval that may be in the range of a few or more milliseconds.

Figure 3:
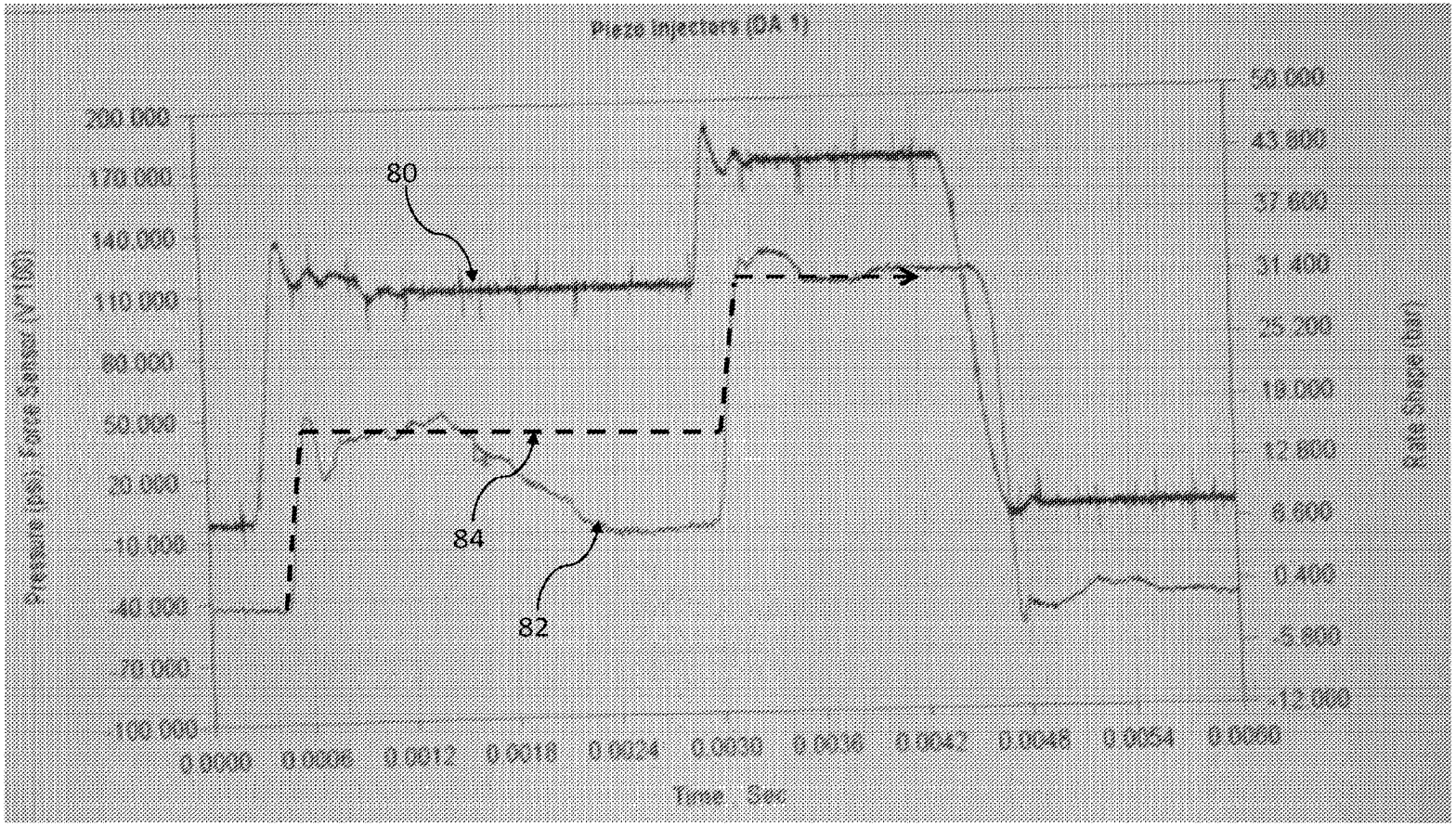
FIG. 3 is a graph depicting rate shape performance of an open-loop control system.
Figure 4:
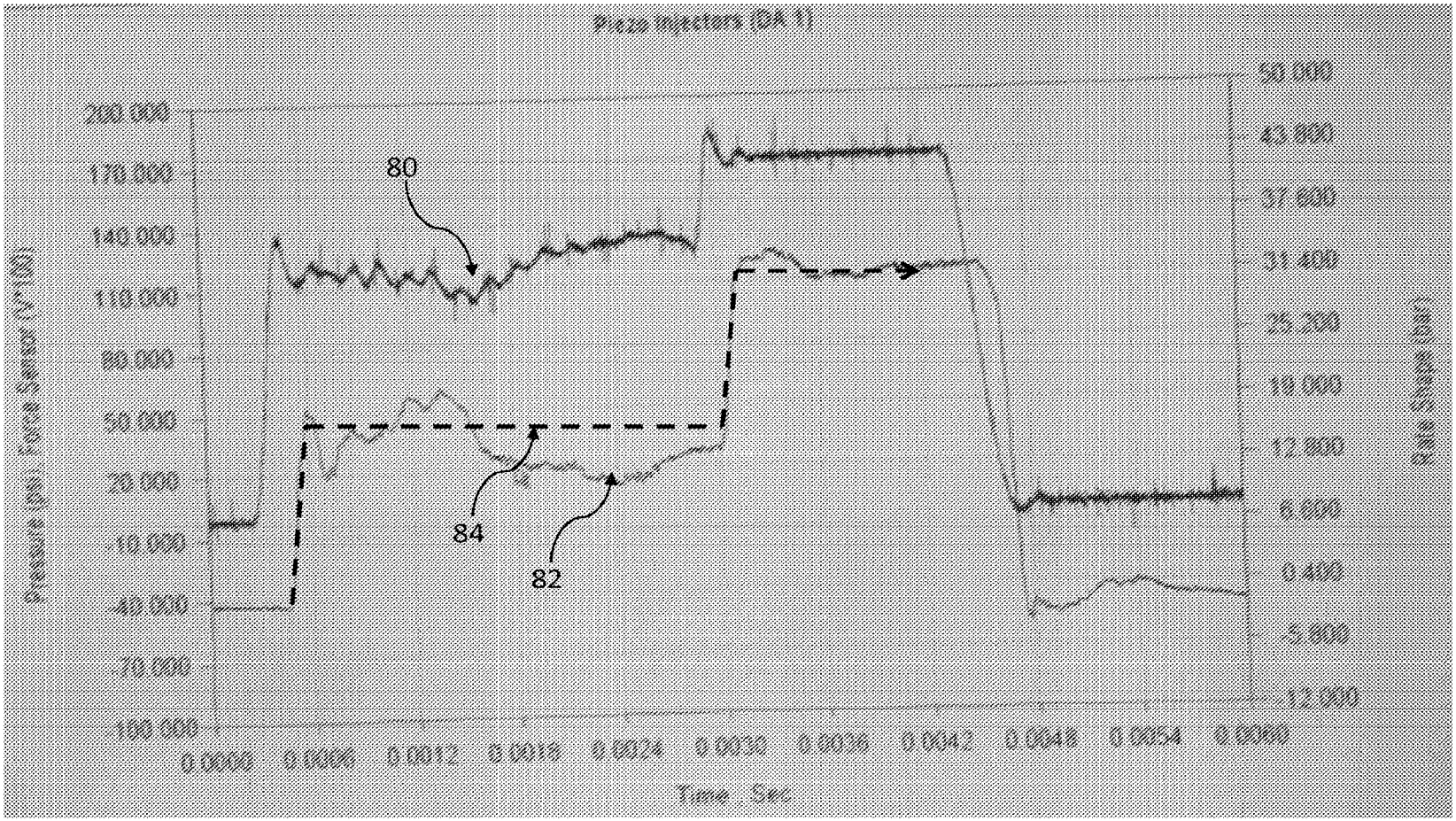
FIG. 4 is a graph depicting rate shape performance of a within-cycle control system.

The closed-loop system for providing within-cycle correction of the drive profile signal for fuel injectors 30 provides more accurate and repeatable rate shaping relative to open-loop systems that infer characteristics of the actual rate shape based on indirect measurements, such as a fuel rail or accumulator pressure. FIG. 3 depicts the performance of an open-loop system wherein the control input is Piezo voltage 80 (i.e., the voltage that drives the actuator of fuel injector 30). As shown, there is a significant deviation between the actual injected rate shape 82 and the target injected rate shape 84, especially during the "boot regime" of between 0.0013 to 0.0030 seconds. FIG. 4 depicts the performance of a closed-loop within-cycle system as described in the Within-Cycle Application. As compared to FIG. 3, it is shown that Piezo voltage 80 is modified by the within-cycle correction techniques, especially within the "boot regime," to result in better correlation between the actual injected rate shape 82 and the target injected rate shape 84. Some systems suffer from a long transport delay (i.e., time delay) between the control input 80 and output. In some cases, the time delay occurs due to the limitations of the physical system not being responsive and/or measurement delay of the sensor. Therefore, minimizing the error between the reference set point and the output can be very challenging because of the time delay. One of the embodiments of the present disclosure addresses this issue.

As indicated above, the present disclosure provides cycle-to-cycle adaptive controls (in addition to the within-cycle controls described above) in a closed-loop system. The present disclosure provides techniques to improve the rate shape performance especially in steady-state operation, by combining the within-cycle controls with cycle-to-cycle adaptation controls wherein the controls learn from the previous cycle operation and correct for errors to provide more precise rate shaping. Therefore, the overall control signal in the present disclosure consists of a within-cycle closed-loop input and an adaption input which learns from the previous cycles of operation as is further described below. The control signal may use one or many types of sensor signals including state estimations. For example, the present disclosure may use body pressure or HPC pressure, Piezo stack voltage/current, Piezo feedback sensor force, Piezo charge, Piezo energy, cylinder pressure, etc., either in an actual sensed format or estimated format. The cycle-to-cycle adaptive controls may use the mean of the error between the target and measured rate shape. Alternatively, the controls could use point by point error between the target and measured rate shape while calculating the controls input. As is further described below, in one embodiment the control system uses an algorithm that estimates the time delay between the sensed/estimated rate shape and control input from a previous cycle's data. The control system advances the calculated control input by the time delay that is determined from earlier data so that it can alleviate or reject the error before it occurs. The system uses a system model to calculate the feed forward portion of the overall controls signal. In some embodiments, the adaption parameters may be saved in a power down state so that the algorithm does not need to re-learn them during the next start up. Moreover, after the adaption has converged, execution of the algorithm may be scheduled less often to observe changes in the adaption parameters. If the adaption parameters change significantly, then the health of the associate fuel injector 30 can be diagnosed by analyzing the adaption parameters. Specifically, the adapted parameter(s) may be compared to a predetermined calibrated threshold to determine whether the health of the associated fuel injector or any other components to which this adaption technique may be applied. It should be noted that some of the diagnostics may be as simple as an individual parameter of the adaption and some health diagnostics may come from algebraic manipulation of multiple adaption parameters.

Figure 5:
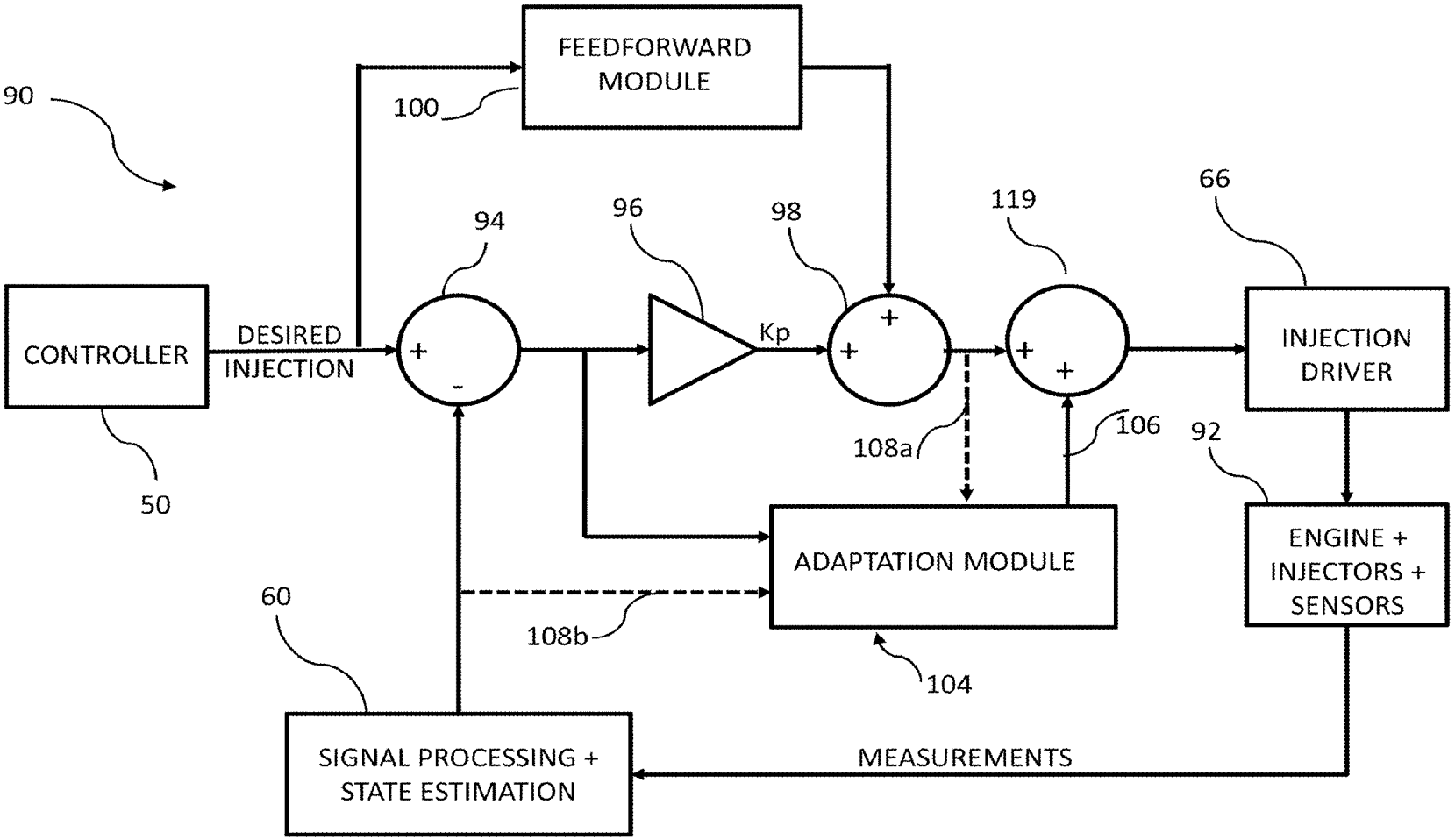
FIG. 5 is a control diagram of a fuel injection control system according to the present disclosure.

Referring now to FIG. 5, a high-level diagram of the control scheme of the present disclosure is shown. As shown, system 90 includes controller 50, injection drivers 66, and interface module 60 of FIG. 2, as well as the above-described engine, fuel injectors and sensors, together represented by block 92. System 90 further includes a summing junction 94, an amplifier 96, a summing junction 98, and a processing block 100. Amplifier 96, summing junction 98 and processing block 100 are all part of an adaptation module 104 according to the present disclosure. In operation, controller 50 provides information to summing junction 94 regarding the desired injection such as quantity, timing and rate shape (i.e., boot, ramp, trapezoid, or other shape). Summing junction 94 provides as an output the difference between the desired rate shape and an estimation of the actual rate shape provided by interface module 60 in the manner described herein. The error signal is provided to adaptation module 104, and more specifically to amplifier 96, which outputs amplifier error signal Kp to summing junction 98. The other input to summing junction 98 is provided by feed forward correction processing block 100 which is derived from the output of controller 50. The adaption module 104 processes the history of summing junction 94 and outputs to junction 119 via line 106. Intuitively, adaption module 104 compares the error profiles of the existing cycle against the error profiles of previous engine cycle(s) and adapts to the control signals when the system is converging and rejects the control signals when the output diverges away from the desired reference injection profile. When a time delay is present, the control signals at the current time instant, $Uinc_{T,K}$ affects the error signal at a much later time instant, $E_{T+N_d,K}$ where, $N_d$ is the number of samples that the error is delayed due to the time delay. The adaption module 104 takes advantage of the previous cycle error at a later time instant, $E_{T+N_d,K-1}$ when generating controls signal, $Uinc_{T,K}$ at a current time instant for the existing cycle (i.e., the incremental adaption signal, $Uinc_{T,K}$ is a function of $E_{T+N_d,K-1}$). In short, the adaption module 104 adapts to the new adapted signal, $UA_{T,K}=UA_{T,K}+Uinc_{T,K}$ when conditions are met otherwise, it reverts back to its previous cycle value, $UA_{T,K}=UA_{T,K-1}$. The condition for adaption depends on minimizing an error at this cycle compared to previous cycle for same time instant. One embodiment of $Uinc_{T,K}$ being adapted is: $Abs(E_{T+N_d,K})<Abs(E_{T+N_d,K-1})$. The output of summing block 98 is added to the output of adaption module 104 via signal 106 in summing block 119. In one embodiment, adaption module 104 can also use the output of summing block 98 via dashed line **108*a* and the output of state estimation block 60 via dashed line 108*b***.

The output summing junction 119 is provided to injection driver 66, which provides the drive profile signal to fuel injector 30 in the manner described above. The measurements representing the actual rate shape are provided from block 92 to interface module 60. As indicated above, these measurements may come from various sensors that provide measurements of rail pressure, HPC line pressure, Piezo stack voltage/current, Piezo stack feedback sensor force, Piezo charge, Piezo energy, cylinder pressure, etc. Interface module 60 processes these signals in the manner described in the Within-Cycle Application to provide an estimation of the actual rate shape to summing junction 94.

Figure 6:
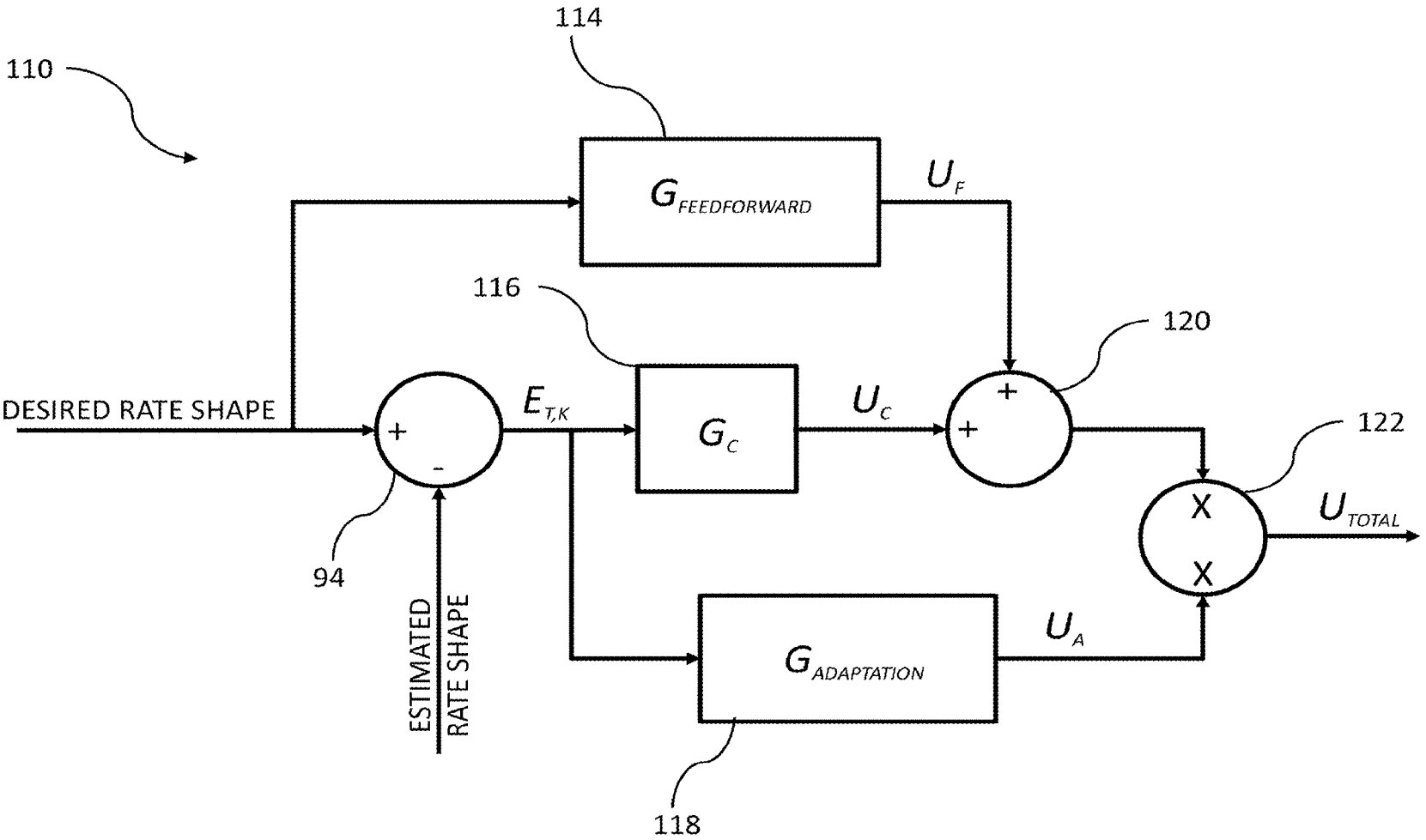
FIG. 6 is a control diagram of an algorithm according to the present disclosure.

Referring now to FIG. 6, a block diagram depicting a control algorithm 110 according to the present disclosure is shown. Algorithm 110 includes summing junction 94 (from FIG. 5), a $G_{FEEDFORWARD}$ transfer function 114, a $G_C$ transfer function 116, a $G_{ADAPTATION}$ transfer function 118, a summing junction 120 and a combination gain and summing junction 122. The positive input to summing junction 94 (i.e., the desired rate shape) is the rate shape input provided by controller 50 of FIG. 5. The negative input (i.e., the estimated rate shape) is the estimation of the actual rate shape provided by interface module 60 of FIG. 5. These signals are combined at summing junction 94 to result in error signal $E_{T,K}$, which is provided to $G_C$ transfer function 116 and $G_{ADAPTATION}$ transfer function 118. As shown, the desired rate shape is also provided to $G_{FEEDFORWARD}$ transfer function 114. The output of $G_{FEEDFORWARD}$ transfer function 114 (i.e., $U_F$) and the output of $G_C$ transfer function 116 (i.e., $U_C$) are combined at summing junction 120. The output of summing junction 120 and the output of $G_{ADAPTATION}$ transfer function 118 (i.e., $U_A$) are combined at junction 120 to produce the overall output control signal of algorithm 110, $U_{TOTAL}$.

$G_{FEEDFORWARD}$ transfer function 114 constitutes the open-loop component of the control signal output, $U_{TOTAL}$, of algorithm 110. As engine operating conditions change or controller 50 otherwise modifies the target rate shape, $G_{FEEDFORWARD}$ transfer function 114 provides that signal to summing junction 120. The output of $G_{FEEDFORWARD}$ transfer function 114, $U_F$, is thus pre-determined based on the operation conditions of engine 10 and saved in a memory (such as a memory of controller 50) as a look-up table or in equation form. It should be noted that $U_F$ is a table or a vector for each injection desired injection rate profile.

$G_C$ transfer function 116 constitutes the closed-loop within-cycle component of the control signal output, $U_{TOTAL}$, of algorithm 110. Based on error signal $E_{T,K}$, $G_C$ transfer function 116 provides closed-loop modifications to the control signal output in the manner described in the Within-Cycle Application, which are combined with the output of $G_{FEEDFORWARD}$ transfer function 114 at summing junction 120. In one embodiment, the simplest form of $U_C$ is: $U_C$=Gain*Error. It should be noted that $U_C$ is a vector and is added point-by-point at summing junction 120 to the $U_F$ vector to minimize the error between the target and the actual rate shape. The form of signal $U_C$ may be a PID control signal, a design of controls based on State Space, Liapunov stability analysis, Optimal controls, Robust controls, etc. The error $E_{T,K}$ calculation could use any or a combinations of the following signals provided by interface module 60 (FIG. 5): injector body pressure or High-Pr line pressure, Piezo/Magnetostrrictive actuator voltage/current, sensor force feedback, actuator charge, energy, cylinder pressure, etc., either in the form of measured signal or in an estimation form.

The output, $U_A$, of $G_{ADAPTATION}$ transfer function 114 is calculated based on the performance index ("PI") or cost function of the current cycle error and a history of similar past cycle's errors One embodiment of the PI is calculated as the absolute value of a sum of all the error samples for a selected time window of interest for any cycle. For example, for the current cycle, $PI_K=\Sigma_{T=1}^{n}\ Abs(E_{T,K})$. For the previous cycle, $PI_{K-1}=\Sigma_{T=1}^{n}\ Abs(E_{T,K-1})$, and so on. In another embodiment, PI is calculated as a sum of the square of the error samples (or a selected time window of samples) for any cycle or an RMS value. In such an embodiment, for the current cycle, $PI_K=\Sigma_{T=1}^{n}\ E_{T,K}^2$. For the previous cycle, $PI_{K-1}=\Sigma_{T=1}^{n}E_{T,K-1}^2$, and so on. The algorithm 110 uses the PI to assess whether the error is minimized from the previous cycle to the current cycle and/or whether the responses have converged. In one embodiment, the incremental change to the adapted controls input, $U_{Inc}$ is defined as $U_{Inc}$ is defined as $U_{Inc}$ (current cycle)=Adaption Gain*$PI_{Current\ cycle}$*Sign(Error) where Adaptation Gain can be a scalar multiplier, Performance Index, PI, is defined earlier and in one embodiment of Sign(Error) can be the positive or negative sign of the error history, $\Sigma_{T=1}^{n}(E_{T,K})$. In one embodiment, the initial output of $G_{ADAPTATION}$ transfer function 118 is $U_A(1)=1+U_{Inc}(1)=1+$Adaption Gain*$PI_1$. It should be understood that $U_{Inc}$ is typically a small increment to the adaption control input, $U_A$, to junction 122 and the size of the $U_{Inc}$, is controlled by the choice of the Adaption Gain. Also, it should be noted that the goal of algorithm 110 is to minimize the Performance Index, PI (which in one embodiment is always positive) below a calibrated threshold for the PI. Typically, the calibrated threshold for the PI is a small number. After the PI is reduced to below the threshold (a process that may take 20 to 30 engine cycles), $U_A$ is maintained at its previous value. Otherwise, $G_{ADAPTATION}$ transfer function 118 increments or decrements $U_{Inc}$ to drive the PI to below the threshold. In other words, if PI of the current cycle>the PI threshold, $U_A$(Next cycle)=$U_A$(Past cycle)+$U_{Inc}$(Current cycle). Otherwise, $U_A$(Next cycle)=$U_A$(Past cycle).

Figure 7:
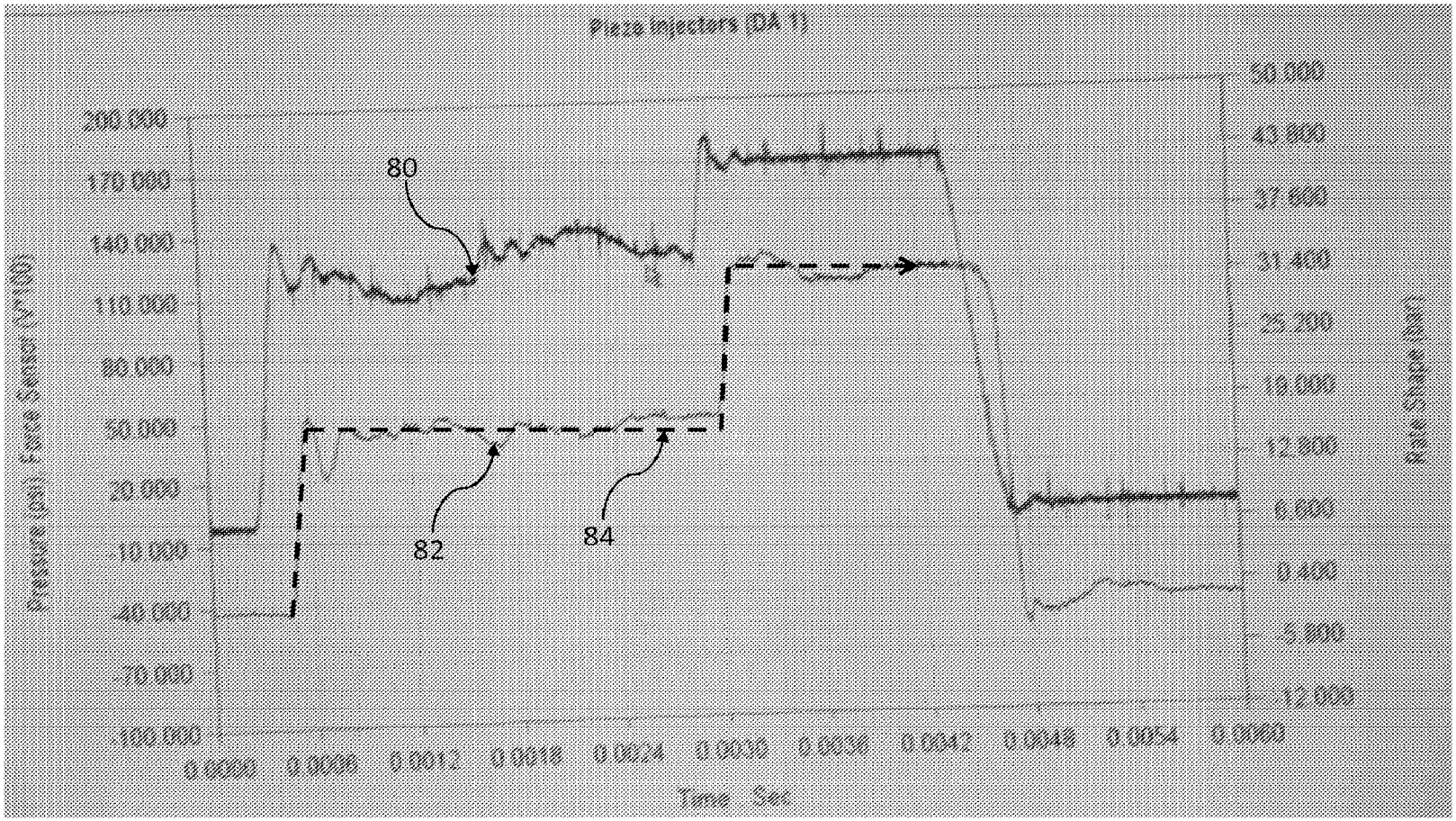
FIG. 7 is a graph depicting rate shape performance of a fuel injection control system according to the present disclosure.

FIG. 7 depicts the performance of a closed-loop within-cycle system as described in the Within-Cycle Application used in conjunction with algorithm 110 of FIG. 6. As compared to FIG. 4, it is shown that Piezo voltage 80 is modified by algorithm 110, especially within the "boot regime," to result in better correlation between the actual injected rate shape 82 and the target injected rate shape 84.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

What is claimed is:

1. A system, comprising:

an engine having a fuel injector;

a controller configured to generate control signals corresponding to a desired fueling profile of a fuel injection event for the fuel injector;

an interface module that outputs drive profile signals to the fuel injector in response to the control signals to cause the fuel injector to deliver an actual fueling profile, wherein the interface module adjusts the drive profile signals to reduce an error between the desired fueling profile and the actual fueling profile in response to a parameter signal indicating a characteristic of the actual fueling profile determined during a cycle of the fuel injection event; and an adaptation module that adjusts the drive profile signals to reduce the error between the desired fueling profile and the actual fueling profile in response to a performance index of the actual fueling profile determined during at least one previous cycle of the fuel injection event.

2. The system of claim 1, wherein the performance index includes an absolute value of a sum of errors between the desired fueling profile and the actual fueling profile for a selected time window of interest.

3. The system of claim 1, wherein the performance index includes a sum of a square of errors between the desired fueling profile and the actual fueling profile for a selected time window of interest.

4. The system of claim 1, wherein the adaptation module generates an adaptation output that is combined with the drive profile signals, the adaptation output for a current cycle being the same as the adaptation output for a previous cycle when the adaptation output for the current cycle does not exceed a threshold.

5. The system of claim 4, wherein the adaptation module modifies the adaptation output for the current cycle by an increment when the adaptation output for the current cycle exceeds the threshold.

6. The system of claim 1, wherein the parameter signal includes at least one of a cylinder pressure, a fuel accumulator pressure, and an engine crank angle.

7. A control system, comprising:

a controller having an output that provides a control signal indicative of a desired rate shape of a fuel injection event;

an interface module having an input that receives the control signal, a feedback output that provides a feedback signal indicative of an actual rate shape of the fuel event and a drive output that provides a drive signal for controlling operation of a fuel injector;

wherein the drive signal includes an open-loop component generated from the control signal, a closed-loop within-cycle component generated from an error between the control signal and the feedback signal during the fuel injection event, and a closed-loop adaptation component generated from an error between the control signal and the feedback signal during a prior fuel injection event.

8. The control system of claim 7, wherein the adaptation component is generated in response to a performance index of the actual rate shape during the prior fuel injection event.

9. The control system of claim 8, wherein the performance index includes an absolute value of a sum of errors between the desired rate shape and the actual rate shape for a selected time window of interest.

10. The control system of claim 8, wherein the performance index includes a sum of a square of errors between the desired rate shape and the actual rate shape for a selected time window of interest.

11. The control system of claim 7, wherein an adaptation module generates the adaptation component such that the adaptation component for a current cycle of operation of the adaptation module is unchanged for a next cycle of operation when a performance index of the adaptation component for the current cycle does not satisfy a criteria.

12. The control system of claim 11, wherein the adaptation module modifies the adaptation component for a current cycle by an increment to generate the adaptation component for the next cycle when the performance index of the adaptation component for the current cycle satisfies the criteria.

13. A method, comprising:

providing a drive profile signal to a fuel injector to cause a fuel injection event having a desired rate shape, the fuel injection event including a plurality of cycles;

determining, for each of the plurality of cycles, an error signal representing a difference between the drive profile signal and a feedback signal indicating an actual rate shape of the fuel injection event;

providing, for a current cycle, a within-cycle adjustment to the drive profile signal in response to the error signal; and providing, for the current cycle, an adaptation adjustment to the drive profile signal in response to the error signal and a performance index of the error signal during a previous injection event.

14. The method of claim 13, wherein the adaptation adjustment is zero when the performance index of the actual rate shape during the previous injection event does not satisfy a criteria and the adaptation adjustment is non-zero when the performance index satisfies the criteria.

15. The method of claim 13, wherein providing an adaptation adjustment includes determining the performance index by computing an absolute value of a sum of errors between the desired rate shape and the actual rate shape for a selected time window.

16. The method of claim 13, wherein providing an adaptation adjustment includes determining the performance index by computing a sum of a square of errors between the desired rate shape and the actual rate shape for a selected time window.

17. The method of claim 13, further including combining a feedforward adjustment to the drive profile signal in response to operating conditions of the fuel injector.

* * * * *